US011441549B2

(12) United States Patent
Dole et al.

(10) Patent No.: US 11,441,549 B2
(45) Date of Patent: Sep. 13, 2022

(54) CONTROLLER FOR HYDRAULIC PUMP

(71) Applicants: Danfoss Power Solutions GmbH & Co. OHG, Neumuenster (DE); Artemis Intelligent Power Ltd., Lothian (GB)

(72) Inventors: Alexis Dole, Midlothian (GB); Uwe Bernhard Pascal Stein, Midlothian (GB); Onno Kuttler, Groß Buchwald (DE)

(73) Assignees: Danfoss Power Solutions GmbH & Co. OHG, Neumunster (DE); Artemis Intelligent Power Ltd., Lothian (GB)

( * ) Notice: Subject to any disclaimer, the term of this patent is extended or adjusted under 35 U.S.C. 154(b) by 59 days.

(21) Appl. No.: 15/518,377

(22) PCT Filed: Sep. 23, 2015

(86) PCT No.: PCT/EP2015/071824
§ 371 (c)(1),
(2) Date: Apr. 11, 2017

(87) PCT Pub. No.: WO2016/058797
PCT Pub. Date: Apr. 21, 2016

(65) Prior Publication Data

US 2017/0306936 A1 Oct. 26, 2017

(30) Foreign Application Priority Data

Oct. 13, 2014 (EP) ..... 14188683

(51) Int. Cl.
*F04B 1/063* (2020.01)
*F04B 49/00* (2006.01)
(Continued)

(52) U.S. Cl.
CPC ..... *F04B 1/063* (2013.01); *F04B 1/04* (2013.01); *F04B 1/0536* (2013.01);
(Continued)

(58) Field of Classification Search
CPC ..... F04B 1/0536; F04B 1/0538; F04B 1/063; F04B 1/04; F04B 49/007; F04B 49/22; F04B 49/00
(Continued)

(56) References Cited

U.S. PATENT DOCUMENTS 5,032,065 A * 7/1991 Yamamuro ..... F04B 1/063 417/428
5,094,597 A * 3/1992 Takai ..... F04B 49/24 417/427
(Continued)

FOREIGN PATENT DOCUMENTS

CN 101827736 A 9/2010
DE 10 2008 005 279 A1 4/2009
(Continued)

OTHER PUBLICATIONS

International Search Report for PCT Serial No. PCT/EP2015/071824 dated Jan. 13, 2016.
Japanese Office Action and English Translation.

*Primary Examiner* — Christopher S Bobish
(74) *Attorney, Agent, or Firm* — McCormick, Paulding & Huber PLLC

(57) ABSTRACT

A hydraulic pump (6) comprising: a housing (20) having first and second inlets (100*a*, 100*b*) and first and second outlets (102*a*, 102*b*); a crankshaft (4) extending within the housing (20) and having axially offset first and second cams (62, 64); first and second groups (30, 32) of piston cylinder assemblies provided in the housing (20), each of the said groups (30, 32) having a plurality of piston cylinder assemblies having a working chamber of cyclically varying volume and being in driving relationship with the crankshaft (4); one or more electronically controllable valves (40) associated with the first and second groups (30, 32); and a controller (70) configured to actively control the opening
(Continued)

and/or closing of the said electronically controllable valves (40) on each cycle of working chamber volume to thereby control the net displacement of fluid by the first and second groups (30, 32), wherein at least the first group (30) comprises a first piston cylinder assembly in driving relationship with the first cam (62) and a second piston cylinder assembly in driving relationship with the second cam (64), and wherein the first group is configured to receive working fluid from the first inlet (100*a*) and to output working fluid to the first outlet (102*a*) and the second group is configured to receive working fluid from the second inlet (100*b*) and to output working fluid to the second outlet (102*b*).

18 Claims, 8 Drawing Sheets

(51) Int. Cl.
*F04B 49/22* (2006.01)
*F04B 1/04* (2020.01)
*F04B 1/0536* (2020.01)
*F04B 1/0538* (2020.01)
*F04B 1/066* (2020.01)

(52) U.S. Cl.
CPC ..... *F04B 1/0538* (2013.01); *F04B 49/007* (2013.01); *F04B 49/22* (2013.01); *F04B 1/066* (2013.01); *F04B 49/00* (2013.01)

(58) Field of Classification Search
USPC ..... 417/273, 270
See application file for complete search history.

(56) References Cited

U.S. PATENT DOCUMENTS 5,167,493 A * 12/1992 Kobari ..... F04B 1/0536 417/273
5,259,738 A * 11/1993 Salter ..... F04B 7/0076 417/270
5,992,944 A * 11/1999 Hara ..... B60T 8/4031 303/10
8,869,521 B2 * 10/2014 Stephenson ..... F04B 49/22 60/468
10,161,423 B2 * 12/2018 Rampen ..... F15B 11/0445
2008/0298982 A1 * 12/2008 Pabst ..... B60T 8/368 417/273
2009/0113888 A1 5/2009 Kuttler et al.
2010/0037604 A1 * 2/2010 Rampen ..... F15B 11/0445 60/445
2011/0031422 A1 * 2/2011 Lopez Pamplona .... F04B 49/03 251/12
2011/0041681 A1 * 2/2011 Duerr ..... F04B 1/0404 91/491
2015/0308419 A1 * 10/2015 Lavender ..... F04B 1/0426 92/72

FOREIGN PATENT DOCUMENTS

DE 10 2009 000 580 A1 8/2010
DE 10 2010 044 697 A1 3/2012
EP 0361927 A1 * 4/1990 ..... F16K 31/082
EP 1 319 836 A2 6/2003
EP 2 055 951 A1 5/2009
JP H04127872 A 4/1992
JP 2013515622 A 5/2013
JP 2014527134 A 10/2014
WO 2005/050015 A1 6/2005
WO 2008/012558 A2 1/2008
WO 2011075813 A1 6/2011
WO 2013/114437 A1 8/2013
WO 2014006663 A1 1/2014
WO 2014/202344 A1 12/2014
WO 2014/202345 A1 12/2014

* cited by examiner

CONTROLLER FOR HYDRAULIC PUMP

CROSS-REFERENCE TO RELATED APPLICATIONS

This application is a National Stage application of International Patent Application No. PCT/EP2015/071824, filed on Sep. 23, 2015, which claims priority to European Patent Application No. 14188683.8, filed on Oct. 13, 2014, each of which is hereby incorporated by reference in its entirety.

TECHNICAL FIELD

The invention relates to: a controller for a fluid working machine; a fluid working machine comprising a controller; and a hydraulic circuit arrangement comprising a fluid working machine.

BACKGROUND

Hydraulic piston pumps typically comprise a central crankshaft which is rotatable about an axis of rotation and a plurality of piston cylinder assemblies. Quite often, hydraulic pumps are designed as hydraulic radial piston pumps, where the plurality of piston cylinder assemblies is arranged about and extending radially outwards from the crankshaft. The piston cylinder assemblies in such hydraulic radial piston pumps are typically arranged in a plurality of axially offset banks of piston cylinder assemblies, each bank comprising a plurality of closely packed piston cylinder assemblies arranged about the axis of rotation and lying on a respective plane extending perpendicularly to the axis of rotation of the crankshaft. The crankshaft comprises at least one cam per bank, and the pistons of each respective bank are arranged in driving relationship with the respective said at least one cam via respective piston feet.

Hydraulic piston pumps can be connected in open loop hydraulic circuits, where fluid is input to the pump from, and output from the pump to, a hydraulic tank, or in closed loop hydraulic circuits where fluid is circulated between the pump and a hydraulic load. For this, the input and output orifices of the individual piston chambers are connected with each other via fluid manifolds. In applications where high pressure fluid is used to power multiple hydraulic loads in different hydraulic circuits, multiple hydraulic pumps are typically required (at least one per hydraulic circuit). For example, in the hydraulic systems typically employed on forklift trucks having hydraulically powered work and propel functions, the work function (e.g. a hydraulic actuator) typically requires high flow rates of working fluid and is therefore better suited to an open loop hydraulic circuit design, whereas the propel function is better suited to a closed loop hydraulic circuit design (as lower flow rates are required, and an open loop design could result in foaming in the tank). Accordingly, to optimise both the work and propel functions, a first hydraulic pump powers the work function in an open loop hydraulic circuit and a second hydraulic pump powers the propel function in a closed loop hydraulic circuit.

Each of the first and second pumps would typically have its own crankshaft, crankcase and pump housing and, although a single torque source (e.g. internal combustion engine or electric motor) typically provides torque to both the first and second pumps, a gearbox is typically required to split torque from the torque source between the crankshafts of the pumps. Accordingly, providing multiple hydraulic pumps adds significant weight to the vehicle, thereby reducing its fuel (or electrical) efficiency. Multiple pumps also take up space. In such applications, it would be beneficial to reduce the weight and size of such hydraulic pumps so that the fuel (or electrical) efficiency of the truck can be increased and/or the size of the forklift truck can be reduced and/or space on the truck can be freed up.

Accordingly, one aim of the invention is to provide hydraulic pumps with reduced weight and size, particularly for use in providing hydraulic power to two or more hydraulic loads on vehicles such as forklift trucks.

SUMMARY

A first aspect of the invention provides a controller for a fluid working machine that is designed and arranged in a way to actuate actively controllable valves associated with a first and second group of piston cylinder assemblies in a way to actively control the net displacement of fluid by the first and second group of piston cylinder assemblies by actuation of said actively controllable valves, wherein the actuation can preferably be controlled on a cycle-by-cycle basis for at least some of the piston cylinder assemblies, and wherein the controller is designed and configured in a way that the actuation of the actively controllable valves of the first and second group of piston cylinder assemblies is performed in a way that the first and the second group of piston cylinder assemblies fulfil fluid flow demands and/or motoring demands independently from each other. In other words, the net displacements of working fluid by the first and second groups of piston cylinder assemblies can be controlled independently of each other.

As it was already mentioned, it is quite common with hydraulic systems that two (or even more) fluid flow circuits and/or consumers have to be served with hydraulic fluid (in case of a hydraulic pumping mode for the respective circuit) or are supplying hydraulic fluid (in the case of a pumping mode of the respective circuit) in a somehow "different way" from another. This "different way" is typically related to the pressure level involved. Quite often, depending on the current requirements, different hydraulic consumers typically require a different pressure level and/or are delivering a different pressure level (e.g. when a regenerative braking system is present and this regenerative braking system is operated in a regenerative braking mode). This different pressure level typically translates to the respective fluid circuit as well. Such different pressure levels can particularly occur in case different types of fluid circuitry are involved (as a predominant example open fluid flow circuits versus closed fluid flow circuits), but are not limited to those. Even, as an example, if only closed fluid flow circuits are involved, different consumers might require different pressure levels (the same applies with open fluid flow circuits). So far, usually different pumps for different purposes had been used according to the state of the art (in particular when splitting up between open fluid flow circuits and closed fluid flow circuits). However, this typically leads to a significantly more complicated overall device, since an appropriately large number of components had to be provided. This resulted in additional cost and additional volume. However, further downsides were correlated with this as well, namely the ability to consider some kind of interdependence between the different fluid flow circuits was clearly missing. Although it is presently suggested that the first and second group of piston cylinder assemblies fulfil fluid flow demands and/or motoring demands independently from each other, this does not necessarily mean (although it is possible) that solely the fluid flow demands/motoring demands ("primary consideration") are taken into account. Instead, it is possible that additional considerations can be envisaged. For example, the creation of actuation patterns for different fluid flow circuits can consider the combined mechanical power demand (so that a driving motor might not be overloaded), resulting mechanical vibration of a driving rod (to reduce such mechanical vibration) or the like. The latter considerations will be addressed as "secondary considerations" in the following, to differentiate it from the "primary consideration" of fluid flow demand/motoring demand. This way an improved overall behaviour can be achieved, although the "primary consideration" can be managed as if (essentially) two (or even more) completely separated pumps/hydraulic motors were present. The consideration of "secondary considerations" can even include the possibility that some (slight) deterioration of the fluid flow output behaviour/mechanical output behaviour (i.e. the "primary considerations") can be tolerated if a (significant) improvement of the behaviour with respect to "secondary considerations" can be achieved (resulting in an improved "overall behaviour" of the fluid working machine). It is to be noted that the controller can be either connected to a (specially adapted) single fluid working machine (with two or more separated fluid inlets and/or fluid outlets) or to different fluid working machines (i.e. potentially replacing a plurality of controllers). The presently suggested controller typically replaces the "previous controllers" as a whole. However, it is also possible that the presently suggested controller replaces the "previous controllers" only in part (for example only driving pulses are generated while the amplification to the finally needed actuation currents is done in connection with an individual pump). The control of the fluid flow demand and/or the motoring demand is usually varied by changing the timing of the opening and/or closing of said actively controllable valves. The timing particularly relates to the percentage of the distance that the respective piston has moved along its stroke in the respective pumping cylinder (for a fluid working machine of a piston-and-cylinder type). This essentially translates to the percentage of the pumpable volume of hydraulic fluid if a full pumping stroke is performed (i.e. if the pump is running at 100%). Possibly some modifications to this rule occur due to an actuation delay by the actuated valve and/or compression effects by the hydraulic fluid. A similar statement can be made if the fluid working machine is operated in motoring mode. This principle as such is known from the state of the art by so-called "digital displacement® pumps" or "synthetically commutated hydraulic pumps". Typically, electricity is used for actuating the respective actively controllable valves (although some different energy form(s) might be envisaged as well). Nevertheless, the controller according to the present invention is not necessarily limited to digital displacement® pumps. However, it has to be mentioned that digital displacement® pump design is particularly preferred, since this enables the controller to control the fluid flow behaviour of the respective piston cylinder assemblies on a cycle-by-cycle basis, which is very advantageous. In particular it is possible to completely change the fluid output behaviour between any two values from one pumping cycle to the other. This results in a very fast adaptable fluid flow output behaviour and/or motoring behaviour. The respective groups that are actuated by the controller can both be "fixed" pumping piston cylinder assemblies and/or motoring piston cylinder assemblies and/or—particularly preferred—"switchable combined pumping and motoring piston cylinder assemblies" (so that they can be switched between these modes). In principle it is possible that one, a plurality or all of the groups of piston cylinder assemblies (in case of two or more of such groups) comprise only a single piston cylinder assembly. However, it is preferred if at least one of the groups, preferably a plurality of the groups, more preferred (essentially) all groups comprise a plurality of piston cylinder assemblies. This way, comparatively large fluid flows can be provided and/or consumed. Furthermore, some "averaging" can be realised, so that less fluid flow spikes result, resulting in a "smoother overall behaviour" of the respective pump/motor. Likewise, in principle an essentially arbitrary design of the fluid working machine(s) connected to the controller can be used. Nevertheless, it is preferred if at least one piston cylinder assembly, preferably a plurality of piston cylinder assemblies or (essentially) all piston cylinder assemblies of at least one of said groups comprise an actively controllable inlet valve and/or an actively controllable outlet valve. In particular, this statement is not only made for at least one of the groups, but preferably for a plurality of the groups, even more preferred for (essentially) all of the groups of at least one, a plurality or (essentially) all of the groups connected to the suggested controller. As it is known from digital displacement® pumps that are known as such in the state of the art, an actively controllable inlet valve is needed (and sufficient) if only a hydraulic pump has to be realised. Hence, both an actively controllable inlet and an actively controllable outlet valve have to be provided usually if a motoring behaviour or a combined pumping and motoring behaviour has to be realised. It has to be noted that a passive valve is of course cheaper to realise (and typically uses less space), so a reduction to actively controllable inlet valves is quite often preferred if the respective group of piston cylinder assemblies has to be operated as a pump, solely. Only for completeness it is to be mentioned that of course a single piston cylinder assembly can be provided with a plurality of (both active and/or passive) inlet and/or outlet valves. Typically, for cost reason, only a single (inlet/outlet) actively controllable valve is provided for each piston cylinder assembly. Furthermore, it is mentioned that not only some (including at least one) of the piston cylinder assemblies of the fluid working machine can advantageously be controlled on a cycle-by-cycle basis, but preferably a plurality of the piston cylinder assemblies, more preferred essentially all piston cylinder assemblies, in particular all piston cylinder assemblies can be controlled on a cycle-by cycle basis.

In the context of the present invention, reference is made to a hydraulic pumping mode and/or a hydraulic motoring mode (i.e. including a combination thereof) of the fluid working machine, where applicable, even if only a pumping mode (or a motoring mode or the like) is mentioned. Likewise, reference is made to a "general" fluid working machine (i.e. a hydraulic pump, a hydraulic motor and/or a combination thereof), where applicable, even if only a hydraulic pump or a hydraulic motor is mentioned, According to a preferred embodiment, the controller is designed and arranged in a way to actuate actively controllable valves of at least a third group of piston cylinder assemblies in a way that the at least said third group fulfils a fluid flow demand and/or a motoring demand independently of the first group and/or the second group of piston cylinder assemblies. This way, (at least) a third pressure level and/or a third "hydraulic characteristic" can be provided as well. With the example of a forklift truck, it is quite common that a more or less continuous need for a propelling hydraulic circuit (closed fluid flow circuit) and for raising and lowering the raisable fork (open fluid flow circuit) is present. Different features are typically needed only "once in a while", so that these features can be served by the third group in an advantageous way. The actuation of the piston cylinder assemblies of the third group can be independent from the first group and/or the second group (in particular with respect to "primary considerations"). However, it is also possible that the third group can be coupled (at least at times) to the first and/or the second group, thus enabling a "boost mode" (which can also be referred to as an "augmenting mode") of the respective group. This will be elucidated later on. All groups (or two out of three groups or the like) might be provided in a single fluid working machine housing. However, a "spreading" over two or more different fluid working machine housings is possible as well.

It is further suggested that for the controller the actuation cycle of the actively controllable valves of at least one of the groups of piston cylinder assemblies is performed in a way to fulfil the requirements of at least an open fluid flow circuit and/or of a closed fluid flow circuit. As already mentioned above, those fluid flow circuits typically show a very different behaviour. In particular, a closed fluid flow circuit quite often shows high fluid flow rates with comparatively low pressure (a typical field of application is for propelling purposes). An open fluid flow circuit, however, typically shows comparatively low fluid flow rates at (at least at times) elevated to high fluid flow pressures. A typical field of application for open fluid flow circuits is the hydraulic piston for raising (and lowering) a fork of a forklift truck. By associating different groups with different "types" of fluid flow circuits (open/closed), a simple design with high fuel efficiency can be provided in connection with a comparatively easy, cost efficient and volume saving build-up.

In particular, it is suggested to design the controller in a way that the actuation of the actively controllable valves of at least one of the groups of piston cylinder assemblies can be adapted to augment the net displacement of fluid of at least a different group of piston cylinder assemblies, in particular in a way that the actuation of the actively controllable valves of at least two groups of piston cylinder assemblies is performed in a way that it is treated as the actuation pattern of a single group. Experience shows that at times an increased demand of hydraulic fluid for certain consumers occurs. This high demand typically occurs only once in a while. Furthermore, a device comprising a plurality of hydraulic consumers is frequently operated in a way that normally an increased fluid flow demand only occurs for a single (or a very limited number of) hydraulic consumer at a time. Therefore, it is highly advantageous to provide some kind of a "basic supply" for different types of hydraulic circuits and to provide "on top" a switchable "boosting service" ("augmenting service") for providing an additional fluid output for such intervals of high demand. Since these intervals of high demand typically occur for different consumers at different times, it is possible that a single (or a limited number of) augmenting groups can serve (essentially) all of the hydraulic circuits (to be augmented), without any major drawback in operation. To stay with the example of a forklift truck, there might be the situation that the fork has to be raised to a very large height once in a while. However, due to the then elongated lever this will usually never be done while the forklift truck is moving. Therefore (since the propelling hydraulic circuit consumes only a little hydraulic fluid) the "augmenting group" can be used to speed up the lifting of the fork. On the contrary, there are situations where the forklift truck has to be moved at a high speed. Typically, however, during intervals of fast driving the fork is neither raised nor lowered at higher speeds. Now, the "augmenting group" can serve to augment the propelling hydraulic circuit. During both examples given, a user will almost never notice that the fluid supply of the respective other hydraulic circuit is limited, since he will usually never demand both at the same time. In the very rare cases where both demands occur at the same time, adverse effects might be noticed, but this is usually more than outweighed by the higher fuel efficiency and the smaller volume needed for the pumps. Although it is in principle possible that the "augmenting group" (typically the third, fourth, fifth, sixth, seventh, eighth and so on—if present—group) is actuated differently from the group that is currently augmented, it is normally preferred that the two groups are "logically switched together" so that the individual piston cylinder assemblies of the two (or more) "coupled" groups are actuated as if a single group would be present. It is to be noticed that due to the unique characteristics of digital displacement® pumps, a switching from augmenting a first to augmenting a second group can usually be done on a cycle-by-cycle basis as well, and vice versa. This includes a "logical switching" from an open fluid flow circuit behaviour to a closed fluid flow circuit behaviour.

Furthermore, it is suggested to design the controller in a way that the controller can actuate the actively controllable valves in a way that at least at times at least one group of piston cylinder assemblies is actuated in a pumping mode, while a second group is actuated in a motoring mode. This way, energy can be recycled and reused for a different purpose, preferably without the need to store (at least part of) the energy that is regained. To stay with the already used example of a forklift truck, braking energy from a propelling hydraulic cycle can be used to perform some "useful" work (for example lifting the fork—on which some goods can be placed). Of course, the third group can be switched to one or another group as well (giving an additional "boost" to the pumping mode or yielding the ability to regain some "excess" mechanical work (for example occurring during hard breaking or when driving down a steep decline)). It should be noted that of course it can be useful as well to regain some mechanical energy in a motoring mode (i.e. where hydraulic energy—typically present in the form of pressure—is converted into mechanical energy) which can be stored for a certain time span. This storing can be done on the "input side" (for example buffering of excess hydraulic fluid in a hydraulic fluid accumulator) and/or on the "output side" of the fluid working machine that is driven in motoring mode (for example using an electric capacitor, an accumulator or a mechanical storage unit or the like). This way, a particularly energy-efficient overall device can be realised.

According to another preferred embodiment the controller is designed and arranged in a way to actuate at least one controllable switching valve for connecting and disconnecting different fluid flow circuits, in particular fluid flow circuits that are associated to at least one group of piston cylinder assemblies. Using such switchable valves, a (changeable) association between different groups of piston cylinder arrangements of the fluid working machine and different fluid flow circuits and/or hydraulic consumers can be established. In particular when three or more groups are used, it is possible to (temporarily) assign the third group to either the first or the second group (and—presumably—to connect three or more groups together in more or less exceptional circumstances). It is even possible to switch the output from one group and/or fluid flow circuit to one or another hydraulic consumer and/or to switch consumers in parallel and/or to disconnect some hydraulic consumers and/or the like.

According to a second aspect of the invention, a fluid working machine is suggested, comprising: a housing, at least a first and a second group of piston cylinder assemblies within said housing, at least one of said groups of piston cylinder assemblies comprising at least one actively controllable valve, and a controller for actuation of said actively controllable valves to thereby control the net displacement of fluid by the at least first and second group of piston cylinder assemblies, and wherein the controller is of a type according to the previous suggestion. This way, the already described advantages and characteristics can be achieved as well, at least in principle. Furthermore, the fluid working machine can be modified in the previously described sense, at least in principle. According to a preferred suggestion, the housing is preferably a "common block". This does not necessarily mean that the housing comprises only a single block. Instead, the housing can comprise several pieces that are assembled together. It is even possible to use a plurality of individual housing blocks that are placed near each other and are preferably tightly connected to each other. In particular, a connection can be established between individual groups of piston cylinder assemblies on the hydraulic fluid side (in particular fluid inlets and/or fluid outlets), in case piston cylinder assemblies that belong to the same group are arranged in different housings (housing units/housing subunits). In particular, the use of fluid manifolds is possible for fluidly connecting such piston cylinder assemblies.

According to another preferred embodiment, the fluid working machine comprises different fluid flow inlets and/or fluid flow outlets, at least for the different groups of piston cylinder assemblies and/or the housing of the fluid working machine comprises a unitary housing, in particular a single-piece housing. Although it is possible that a plurality of fluid flow inlets/outlets is provided for even a single group of piston cylinder assemblies, it is preferred to reduce the number of fluid flow inlets/fluid flow outlets to a small number, preferably down to one (of each type). This way, the effort for (fluidly) connecting the fluid working machine with the "remaining overall device" can be reduced, since fewer (pressure proof) hydraulic fluid connections have to be made. This way, leakage problems can be reduced as well. However, it is of course possible to provide a (preferably small) number of fluid inlets/outlets for a single group and to interconnect the respective inlets/outlets via "separate manifold(s)", as well, in particular, if this way the design of the fluid working machine can be (significantly) simplified (for example two, three, four, five, six, seven, eight or even more fluid flow inlets/fluid flow outlets for at least one of the groups can be provided). It is to be noted that typically at least as many fluid flow inlets/fluid flow outlets are necessary (presumably multiplied with a factor like two, three, four, five, six, seven, eight, nine, ten or even higher), as separate (sub-) units of the housing of the fluid working machine are present. This way, a single-piece housing (or tightly connected subunits of a more complex housing) is preferred, since the number of fluid flow inlets/outlets can typically be reduced.

It is furthermore preferred if the fluid working machine comprises a crankshaft extending within the housing and having at least one cam and wherein said piston cylinder assemblies comprise a working chamber of cyclically varying volume and being in driving relationship with said crankshaft. The working chamber of cyclically varying volume is typically the volume between the cylinder and the piston. As the piston reciprocates cyclically within the cylinder, the working chamber volume also varies cyclically. The piston is typically slidably mounted or coupled to the cam with the piston cylinder assembly comprising the piston in driving relationship. The cylinders of the piston cylinder assemblies may be coupled to or integrally formed with the valve unit(s) and coupled to (e.g. screwed into or fastened to) the respective housing bores and/or the cylinders may be defined by the respective housing bores (or a combination of these options may be employed). Some or (typically) all of the pistons may be arranged such that when they reciprocate in the cylinders of the respective piston cylinder assemblies they rotate (and rock) about a respective rocking axis (substantially) parallel to the axis of rotation. By a first feature being "in driving relationship" with a second feature we mean that the first feature is configured to drive and/or to be driven by the second feature. This way, a particularly efficient, simple, cost-efficient, mechanically durable and volume reducing design can be realised. In particular, the fluid working machine can be (at least in part) designed as being of a "wedding cake type" with piston cylinder assemblies being directed in an (essentially) radial direction and arranged at preferably periodical, in particular at regular intervals along a tangential direction around the axis of rotation of said crankshaft.

Shaft position and speed sensor may be provided which determines the instantaneous angular position and speed of rotation of the shaft, and which transmits shaft position and speed signals to the controller. The controller is typically a microprocessor or microcontroller which executes a stored program in use. The opening and/or the closing of the valves is typically under the active control of the controller. Typically a single controller controls the net displacement of fluid by the first and second groups (and, where provided, additional groups).

In particular, the fluid working machine can comprise at least two axially offset cams, wherein preferably piston cylinder assemblies associated with at least one of said groups of piston cylinder assemblies are in driving relationship with different cams of said crankshaft. This way a very compact design can be realised in that the fluid working machine comprises several banks that are designed as a "slice" that are stacked on top of each other, where each individual slice comprises a plurality of piston cylinder assemblies that are arranged along a tangential direction around the axis of rotation of the crankshaft. By using the same crankshaft, it is easy to drive the whole fluid working machine by a single mechanical energy producing device, like a combustion engine or an electric motor. By providing two cams, each slice comprising piston cylinder assemblies can be actuated in a matched way. In particular, the cams can show some rotational offset with each other. This way, it is possible to reduce pressure pulsations or the like and/or to smooth the torque-over-driving angle-curve of the mechanical input needed to drive the fluid working machine.

It is further suggested to design the fluid working machine in a way that the piston cylinder assemblies associated with at least two different ones of said groups of piston cylinder assemblies are in driving relationship with the same cam of said crankshaft, in particular in a way that they are arranged alternately in a tangential direction, circumferential around said crankshaft. This design feels a little bit awkward and counter-intuitive, because one is tempted to associate piston cylinder assemblies belonging to the same group within the same "slice" (a design that is possible as well, of course). However, the proposed design enables one to provide fluid flow conduits (in particular fluid inlet conduits and/or fluid outlet conduits) that are arranged essentially parallel to the axis of the crankshaft in a way that piston cylinder assemblies belonging to the same group are fluidly connected to the respective fluid conduit. This way, the fluid conduit can be simple and nevertheless be served by (at least) two or three different piston cylinder assemblies (in particular the same number as there are "slices" present; however, it is possible that at least in some of the slices two piston cylinder assemblies that are arranged neighbouring each other along a tangential direction within the same slice can fluidly connect to a single fluid channel). This way, when seen along a tangential direction around the crankshaft, typically fluid flow conduits belonging to different groups will be arranged in a circumferential direction in relation to the crankshaft. Only for completeness it is pointed out that it is likewise possible that fluid conduits belonging to one or different groups will show an opening to the outside at the same or at different face sides of the housing of the fluid working machine.

According to a third aspect of the invention a hydraulic circuit arrangement is suggested, comprising: a fluid working machine, said fluid working machine comprising at least first and second fluid flow connections for hydraulic fluid flow circuits serving hydraulic loads, the first fluid flow connection of the fluid working machine being designed to be connected to a first hydraulic fluid flow circuit and the second fluid flow connection being designed to be connected to a second hydraulic fluid flow circuit. With such a design the previous features and advantages described with respect to the suggested controller and/or to the suggested fluid working machine can be achieved as well, at least in analogy. Furthermore, the hydraulic circuit arrangement can be modified in the already described way as well, at least in analogy.

In particular the hydraulic circuit arrangement can be designed in a way that at least one of said first and second fluid flow connections of the fluid working machine comprises a working fluid outlet connection and a working fluid inlet connection, wherein preferably the first working fluid inlet connection is designed to be fluidly connected to a first working fluid source and the second working fluid inlet connection is designed to be fluidly connected to a second working fluid source. This way, a single fluid working machine can serve fluid flow circuits (at least temporarily) that necessitate a different characteristic like a different pressure level. Nevertheless, despite the "individual serving" of the different fluid flow circuits, a single pump can be sufficient, resulting in reduced mounting space and enabling a simplified and more energy-efficient driving unit. In particular, by not only separating the fluid outlet sides, but also the fluid inlet sides, the respective fluid circuits can be "completely" separated from each other. This is particularly useful if one of the fluid circuits is an open fluid flow circuit while the other one is a closed fluid flow circuit. Here, not only one side of the circuit is different in its characteristics (for example the pressure level), but also the fluid inlet sides are typically different. Nevertheless, independent of the exact design of the hydraulic circuit arrangement, it is possible that the fluid working machine can be designed in a way that said at least first and second fluid flow connections are configured to provide fluid of a different pressure level and/or to provide fluid for different types of hydraulic fluid circuits (in particular for an open fluid flow circuit and/or a closed fluid flow circuit).

When talking about a "complete" separation of the fluid flow circuits this does not exclude that some leakage flow or some connection between the different circuits by pressure relief valves, a fluid orifice (for effectuating some thermal exchange between the two or even more fluid circuits) or the like are foreseen and/or can occur.

In particular, it is possible to design the hydraulic circuit arrangement in a way, wherein the fluid working machine comprises at least a first and a second group of piston cylinder assemblies, wherein said first group of piston cylinder assemblies is associated with a first fluid flow connection, and wherein the second group of piston cylinder assemblies is selectively fluidly connected to the first and second fluid flow connection via switching circuitry. This way, it is possible to change the number of piston cylinder assemblies that are associated with the respective fluid flow circuit and/or that are associated with the respective consumers. This way, it is easy to change the fluid flow range to the respective fluid flow circuits in a very wide range, thus enabling a "fluid flow rate boost" to some of the hydraulic consumers at a time. As it has been already noted, quite often hydraulic consumers are present that do not have a significant fluid flow demand at the same time (i.e. in respect of significant fluid flow demand they are typically operated on a "mutually exclusive" basis). By changing number of piston cylinder assemblies (including the possibility of a single piston cylinder assembly) that are associated to the respective consumer(s), a fluid working machine can be achieved that supplies (or consumes) sufficient fluid flow rate for essentially all realistically occurring fluid flow requirements (or supply), while the fluid working machine can be of a comparatively small size. This has to be compared to a situation where for every individual hydraulic consumer (or for every individual group of hydraulic consumers) a respective sufficient number of piston cylinder assemblies is foreseen.

While it is possible that only two groups of piston cylinder assemblies are around and are interconnected to individual fluid flow circuits/hydraulic consumers via switching circuitry, it is preferred if the fluid working machine comprises at least a third group of piston cylinder assemblies, wherein said at least third group of piston cylinder assemblies is either fixedly fluidly connected to a fluid flow connection or selectively fluidly connected to a fluid flow connection. In case some switching circuitry is provided and the third group of piston cylinder assemblies is selectively fluidly connected to (one of the) other groups, a particularly useful "boost mode" or "augmenting mode" can be realised. Even if the third group is fixedly fluidly connected to a fluid flow connection, this design can be used if a third fluid circuit is around that is operated with significantly different characteristics as the other ones. Of course a fourth, fifth and so on group can be provided as well, where the previously mentioned facts can apply, at least in analogy.

In particular it is suggested that the hydraulic circuit arrangement comprises at least a controller according to the previous suggestions and/or that the hydraulic circuit arrangement comprises a fluid working machine according to the previous suggestions. This way, a hydraulic circuit arrangement can be realised that shows the same features and advantages as already described, at least in analogy, and wherein the hydraulic circuit arrangement can be modified in the previously described sense, at least in analogy.

The preferred and optional features discussed above are preferred and optional features of each aspect of the invention to which they are applicable. For the avoidance of doubt, the preferred and optional features of the first aspect of the invention are also preferred and optional features of the second and third aspects of the invention, where applicable. Similarly the preferred and optional features of the second aspect of the invention are also preferred and optional features of the first and third aspects of the invention, where applicable (and so on).

BRIEF DESCRIPTION OF THE DRAWINGS

An example embodiment of the present invention will now be illustrated with reference to the following Figures in which.

DETAILED DESCRIPTION

As already described, it is envisaged that, in some circumstances, the hydraulic pump-motor 10 will also at times operate in pumping mode (e.g. in a regenerative braking system). Accordingly, the pump-motor 10 is connected to the hydraulic pump 6 via directional flow control circuitry 13 which allows the direction of flow to be reversed, thereby allowing the pump-motor 10 to rotate during operation in either direction in either motoring or pumping mode.

In the following, the invention is further described by reference to a specific embodiment of the hydraulic pump 6. Of course, if a description or explanation is given with respect to the fluid circuitry, the controller or any other device that is (essentially) independent from the exact design of the hydraulic pump 6, the respective feature is deemed to be disclosed in connection with any type of fluid working machine as well.

For elucidating the benefits of the presently suggested controller, fluid working machine and hydraulic circuit arrangement, as an example of application of said devices a forklift truck is described in the following. However, it has to be understood that the presently suggested devices can also advantageously work in different environments and/or with a variety of modifications as well.

Figure 1:
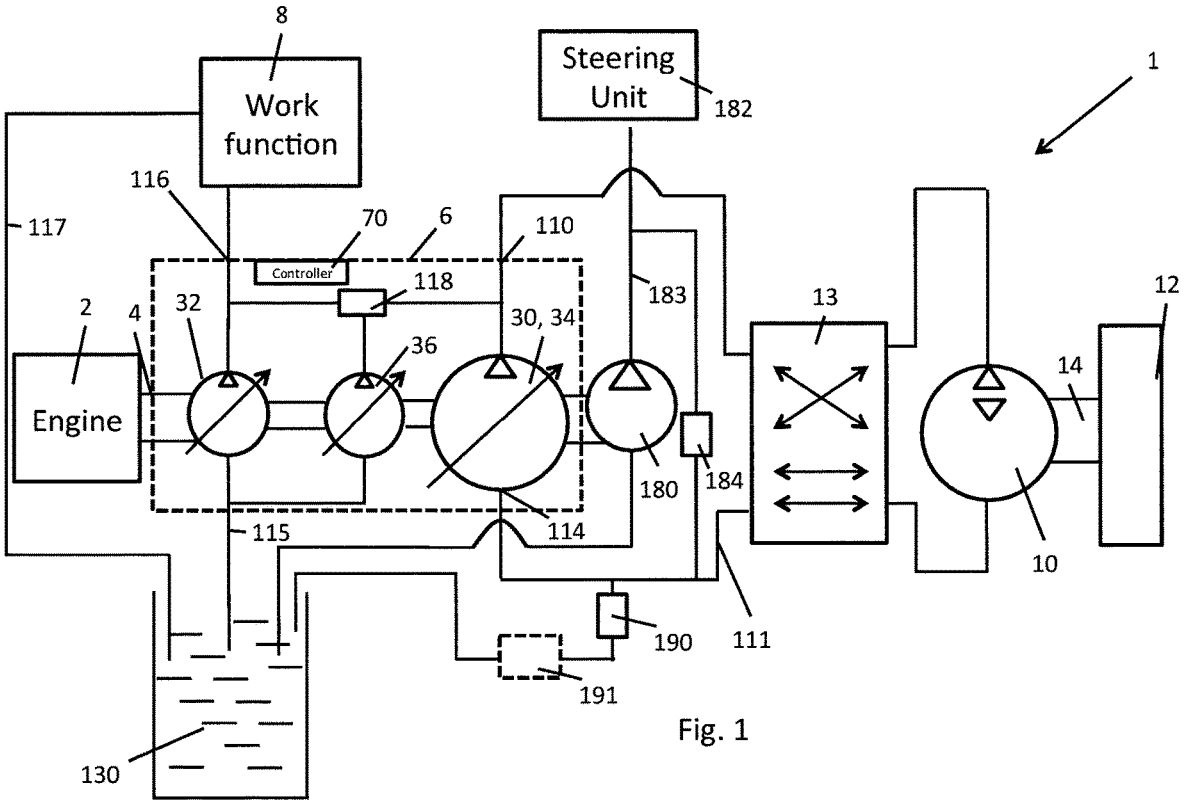
FIG. 1 is a block diagram illustrating a hydraulic system of a forklift truck.
Figure 2A:
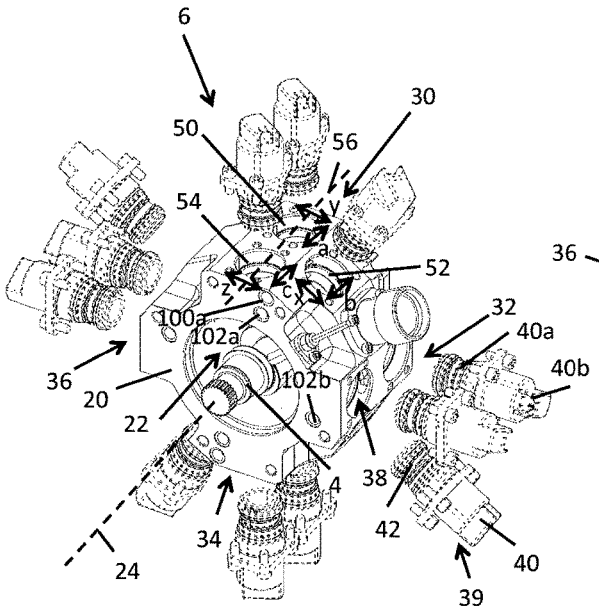
FIGS. 2*a* and 2*b* are exploded perspective and frontal views of a cylinder block and a crankshaft of a hydraulic pump of the hydraulic system of FIG. 1.
Figure 2B:
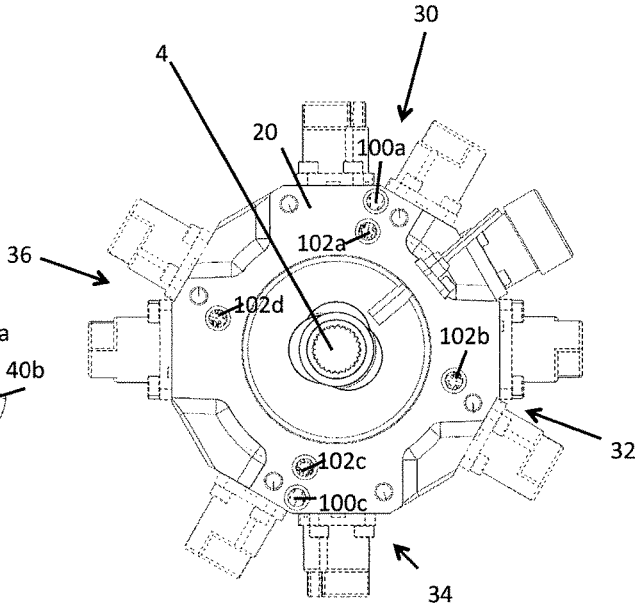
Figure 3A:
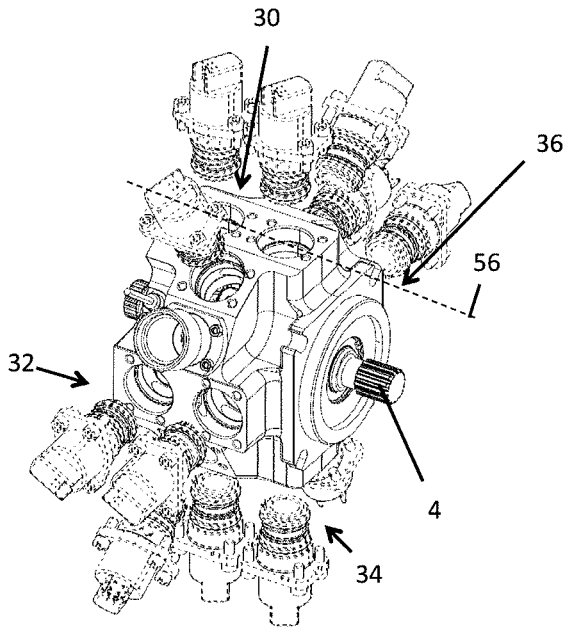
FIGS. 3*a* and 3*b* are exploded perspective and rear views of the cylinder block and crankshaft shown in FIGS. 2*a* and 2*b;*
Figure 3B:
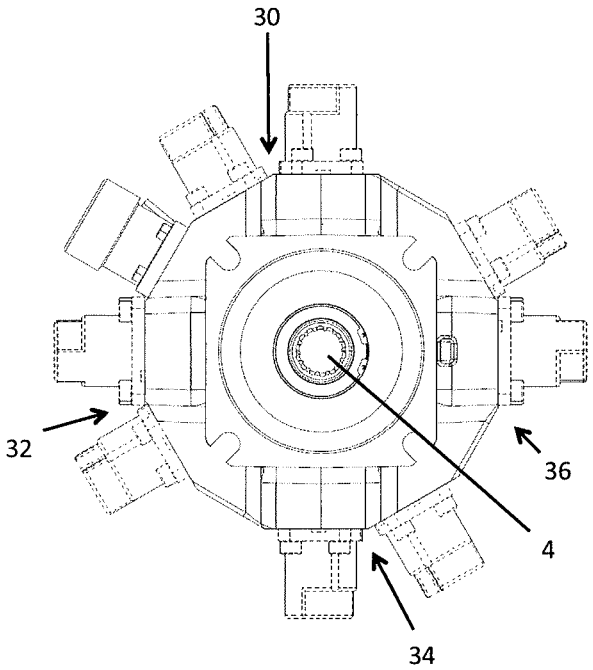
Figure 4A:
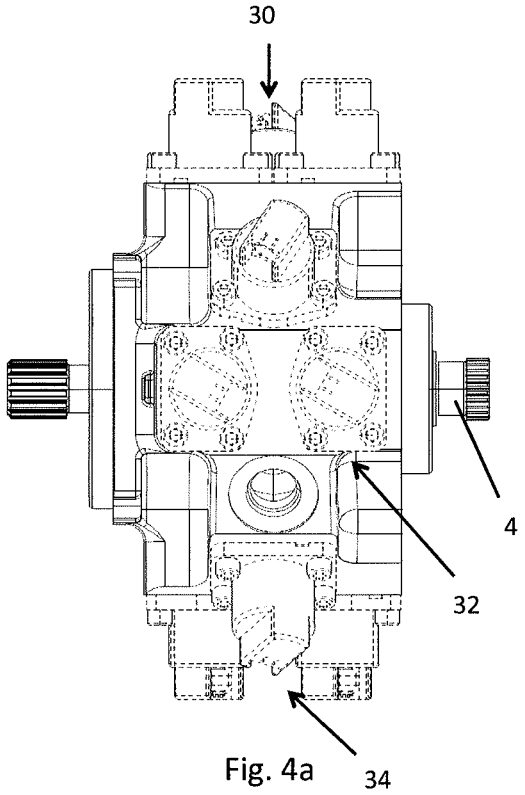
FIGS. 4*a* and 4*b* are side views of the cylinder block and crankshaft of FIGS. 2*a*, 2*b*, 3*a* and 3*b;*
Figure 4B:
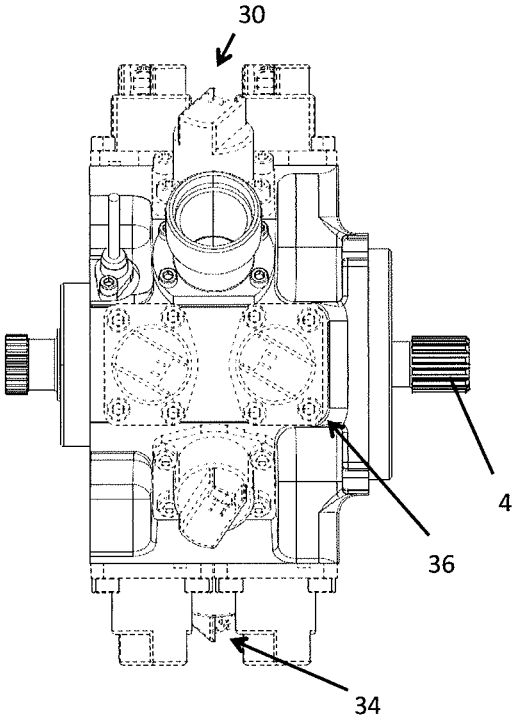

For the presently chosen example, FIG. 1 is a block diagram of a hydraulic system 1 provided on a forklift truck comprising a mechanical torque source 2 (e.g. an internal combustion engine or an electric motor) driving a common crankshaft 4. As it is typical for a forklift truck, a plurality of different hydraulic consumers are present. It is even possible that some devices provide a pressurised fluid flow stream at certain times. In the presently depicted case a propelling fluid circuit 110, 111 can be operated in a pumping mode (e.g. as a regenerative braking system). In the presently shown example, a hydraulic actuator 8 (or a different work function), a propelling fluid circuit 110, 111 for driving a hydraulic pump-motor 10 that is connected to (typically) two or more wheels 12 and a steering unit 182 are provided. All three different units 8, 10, 182 require a fluid flow supply with a different characteristic. In particular, the steering unit 182 needs a comparatively low fluid flow stream, albeit at very high pressure. The work function 8 is typically served by an open fluid flow circuit 116, 117 at usually (for significant times) comparatively low fluid flow rates and at high-pressure, wherein once in a while high fluid flow rates occur (an example for this is a fluid circuit for serving the fork of a forklift truck), and finally the hydraulic pump-motor 10 that is operated at comparatively low pressure, but with frequently high fluid flow rates via a closed fluid flow circuit 110, 111.

According to the state of the art, for the three different consumers 8, 10, 182 three different pumps 30, 32, 34, 180 were provided, each being controlled by an individual controller (not shown in FIG. 1). This was the case, although the different pumps 30, 32, 34, 180 were driven by the same engine via a common crankshaft 4. According to the state of the art, it was also proposed to provide a "boost pump" 36 that could be selectively connected to one or the other fluid flow circuit 110, 111, 116, 117 via a switchable valve 118 to temporarily increase the fluid flow rate of the respective hydraulic circuit, typically considerably. Again, the boost pump 36 was usually designed as a separate pump, being operated by an individual controller.

According to the present proposal, it is suggested to use for at least some of the pumps depicted in FIG. 1 (in the presently depicted embodiment all pumps 30, 32, 34, 36, 180) a single, common controller 70. Furthermore, some of the different pumps 30, 32, 34, 36 are combined in a common housing, which is schematically shown by the dashed line 6 (which will be elucidated in the following). The controller 70 also controls the switching of the switching unit 118 (a switching valve) via which the boost pump 36 can be selectively connected to one of the fluid circuits serving either the work function 8 or the hydraulic pump-motor 10, for augmenting the fluid flow output of the respective pump 30, 32, 34.

The advantage of a common controller 70 is that the different pumps can be actuated in a way that not only the "primary consideration" of fluid flow rate is considered, but additionally "secondary considerations" can be taken into account. The influence of "secondary considerations" can be in a way that a slight degradation of the fluid flow rate performance can occur if a (significant) improvement of "secondary considerations" can be realised (thus improving the "overall performance" of the fluid working machine). As an example, this way it is possible that spikes in the required torque for driving all of the pumps 30, 32, 34, 36, 180 via the common crankshaft 4 can be avoided at least to some extent, typically quite considerably. Thus, the engine 2 can be of a smaller size, which is an advantage. Furthermore, the actuation by the controller 70 can be chosen in a way that mechanical vibration or the like can be reduced, as well.

In the presently shown example, all of the pumps are designed as so-called digital displacement pumps®, which are known as such in the state of the art. The advantage of such pumps is that the fluid flow output behaviour of the respective pumps can be almost arbitrarily varied on a cycle-to-cycle basis. This is particularly advantageous for the boost pump 36 (boost pump part 36), since it can be quickly changed between the different requirements of an open fluid flow circuit 116, 117 and a closed fluid flow circuit 110, 111 (including the possibility to switch the closed hydraulic fluid circuit 110, 111 from a driving mode where the hydraulic pump-motor 10 is driven, to a motoring mode, where the hydraulic pump-motor 10 is producing mechanical energy and a regenerative braking system is achieved).

The hydraulic pump 6, which may be either a dedicated hydraulic pump or a hydraulic pump-motor operable as a pump or a motor in different operating modes, is shown in more detail in FIGS. 2-7. The hydraulic pump 6 comprises a monolithic cylinder block 20 (which acts as a pump housing) comprising a central axial bore 22 within which the crankshaft 4 extends. The crankshaft 4 is rotatable about an axis of rotation 24 parallel with the direction in which the crankshaft 4 extends through axial bore 22. The cylinder block 20 comprises four groups 30, 32, 34 and 36 of housing bores 38 (formed by drilling drillways through the cylinder block 20 or by casting holes in the cylinder block 20 which are typically subsequently drilled) sized and arranged to receive (and/or to help to define) respective valve cylinder devices 39 (to thereby form respective groups of valve cylinder devices), each of the valve cylinder devices 39 comprising an integrated valve unit 40 in fluid communication with (and coupled to) a cylinder 42. The cylinders 42 may be omitted, and the housing bores 38 may alternatively define the cylinders of the valve cylinder devices 39.

The housing bores 38 are disposed about the crankshaft 4 and extend (typically radially or substantially radially) outwards with respect to the crankshaft 4. Each of the groups 30, 32, 34, 36 of housing bores 38 are spaced from adjacent groups of housing bores 38 about the axis of rotation 24. In the illustrated embodiment, the groups 30, 32, 34, 36 of housing bores 38 are substantially identical. Unless otherwise stated, features of the first group 30 are also (in the illustrated embodiment) features of the other groups 32, 34, 36. The valve cylinder devices of the first group 30 are typically provided on the same planes as the corresponding valve cylinder devices of the other groups 32, 34, 36 (i.e. corresponding valve cylinder devices between groups have axial extents which (typically fully) overlap). Accordingly, only the first group 30 is described in detail below. However, in other embodiments there may be variations between groups, such as the number of housing bores 38 (and thus the numbers of valve cylinder devices 39) per group, the positions of working fluid inlets through which working fluid may be provided to the groups, the positions of working fluid outlets through which working fluid may be output from the groups and the configurations of the common conduits (see below).

The first group 30 of housing bores 38 comprises first, second and third housing bores 50, 52, 54. The first and third housing bores 50, 54 are axially displaced from each other in a direction parallel to the axis of rotation 24, and aligned with each other along an alignment axis 56 (see FIG. 2*a*) which extends between the centres of the first and third housing bores 50, 54 in a direction parallel to the axis of rotation 24. The second housing bore 52 is axially offset from (and axially between) the first and third housing bores 50, 54 and the second housing bore 52 is also (rotationally) offset from the first and third housing bores 50, 54 in a clockwise direction as viewed in FIG. 2*a* about the axis of rotation 24 by an angle of approximately 30° (measured from the alignment axis 56 to the centre of the second housing bore 52 about the axis of rotation 24). The second housing bore 52 has an axial extent, b, which overlaps with the axial extents a and c of the first and third housing bores 50, 54 (see FIG. 2*a*), while the axial extents of the first and third housing bores 50, 54 do not typically overlap with each other. By axially offsetting the second housing bore 52 from the first and third housing bores 50, 54, (rotationally) offsetting the second housing bore 52 from the first and third housing bores 50, 54 about the axis of rotation 24 and overlapping the axial extent b of the second housing bore 52 with the axial extents a, c of the first and third housing bores 50, 54, the first group 30 of housing bores 38 is provided with a space efficient nested arrangement. This allows a greater number of housing bores 38 (and thus valve cylinder devices) to be incorporated into a cylinder block 20 of a given axial length (i.e. a given length in a direction parallel to the axis of rotation 24). The second housing bore 52 also has an extent, x, about the axis of rotation which does not in this case overlap with the extents, y, z of the first and third housing bores 50, 54 about the axis of rotation (although in other embodiments the extent, x, of the second housing bore 52 may overlap with the extents y, z of the first and/or third housing bores 50, 54 about the axis of rotation 24).

The integrated valve units 40 typically comprise a threaded end 40*a* which can be screwed into corresponding threads provided in radially outer (with respect to the axis of rotation 24) ends of the housing bores 38 to retain the valve units 40 in the housing bores 38. Additionally or alternatively threads may be provided on the outer diameters of the cylinders 42 (where provided) which mate with threads of the housing bores 38. The valve units 40 also each comprise a valve head 40*b* provided at a second (radially outer with respect to the crankshaft 4) end of the valve unit 40 opposite the threaded end 40*a*.

Figure 5:
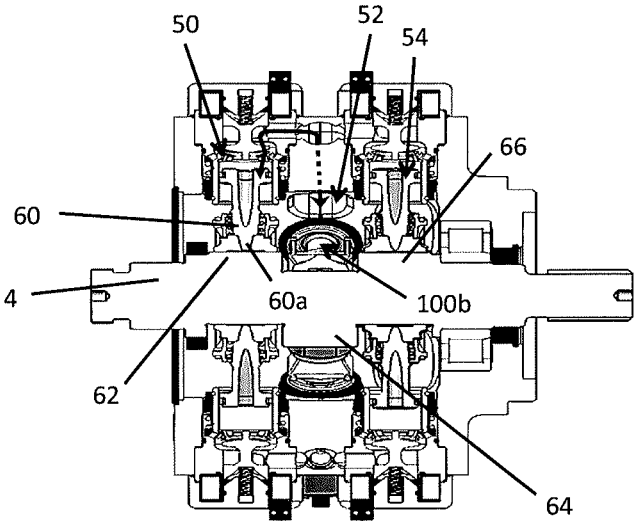
FIG. 5 is a side sectional view of the cylinder block and crankshaft of FIGS. 2-4.
Figure 6A:
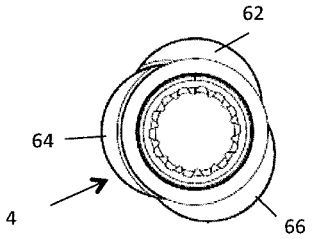
FIGS. 6*a*-6*d* are frontal, perspective and respective side views of the crankshaft of FIGS. 2-5, FIGS. 6*b* and 6*d* showing the crankshaft at different stages of rotation.
Figure 6B:
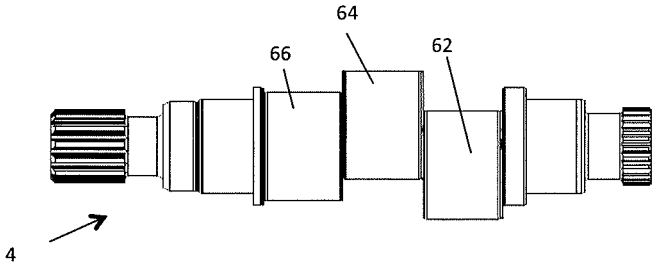
Figure 6C:
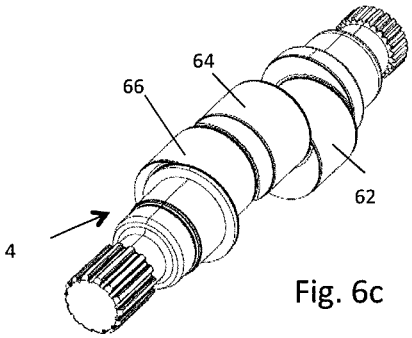
Figure 6D:
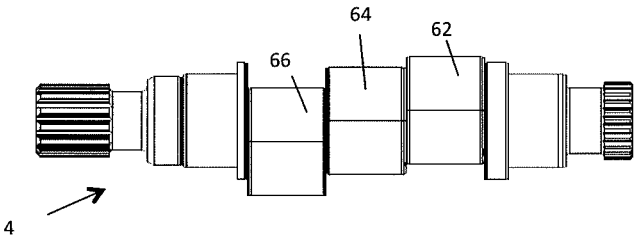

As shown in FIG. 5, radially inner (with respect to the axis of rotation 24) ends of the cylinders 42 (or of the housing bores 38) comprise apertures which reciprocably receive respective pistons 60 in driving relationship with the crankshaft 4 (to thereby form respective groups of piston cylinder assemblies). For brevity, the groups of piston cylinder assemblies provided in the corresponding groups of housing bores 30, 32, 34, 36 will be referred to below using reference numerals 30, 32, 34, 36.

As shown in FIG. 5 and FIGS. 6*a*-6*d*, the crankshaft 4 comprises first, second and third cams 62, 64, 66 (which in the illustrated embodiment are eccentrics) which are axially displaced from each other. The pistons 60 each comprise piston feet 60*a* resting on (and in driving relationship with) a respective cam 62, 64, 66 of the crankshaft 4. More specifically, via respective piston feet 60*a*, the first cam 62 is in driving relationship with the piston 60 reciprocating in the valve cylinder device 39 provided in the first housing bore 50; the second cam 64 is in driving relationship with the piston 60 reciprocating in the valve cylinder device 39 provided in the second housing bore 52; and the third cam 66 is in driving relationship with the piston 60 reciprocating in the valve cylinder device 39 provided in the third housing bore 54. As the torque source 2 rotates the crankshaft 4, the said pistons 60 are driven by the respective cams 62, 64, 66 to cyclically reciprocate within the respective cylinders 42 (or housing bores 38) in a radial or in a substantially radial direction with respect to the axis of rotation 24, thereby cyclically varying the volumes of respective working chambers defined between the respective pistons 60 and the cylinders 42 (or housing bores 38) in which they reciprocate. The pistons 60 are arranged such that when they are driven by the respective cams 62, 64, 66 of the crankshaft 4, they also rotate (and rock) about respective rocking axes parallel to the axis of rotation.

By spacing the groups 30, 32, 34, 36 from each other about the axis of rotation 24, the radial extent of the crankshaft 4 can be reduced (compared to closely packing the groups around the crankshaft 4). This is explained as follows. There is a need for the piston feet 60*a* to be able to rest against the respective cam with which they are in driving relationship. Spacing the groups 30, 32, 34, 36 from each other about the crankshaft 4 reduces the number of piston cylinder assemblies which can be provided around the crankshaft 4 and, because fewer piston feet need to rest on each cam 62, 64, 66, the surface areas of the cams 62, 64, 66 do not need to be as large and the radial extents of cams 62, 64, 66 can be reduced accordingly. In addition, the cylinder block 20 can be made mechanically stronger than a cylinder block in which the housing bores 12 are more closely packed because (strengthening) material is provided in the space between the groups about the axis of rotation 24.

In order to provide a smooth output of pressurised hydraulic fluid, it is preferable for the piston cylinder assemblies of the first group 30 to output pressurised working fluid at phases which are equally spaced (or at least substantially equally spaced). Accordingly, the first, second and third cams 62, 64, 66 are (rotationally) offset from each other about the axis of rotation 24 of the crankshaft 4. As explained above, the second housing bore 52 is (rotationally) offset from the first and third housing bores 50, 54 about the axis of rotation. Thus, in order to provide a smooth working fluid output, the cams 62, 64, 66 are not equally distributed (0°, 120°, 240°) about the axis of rotation. Rather, the second cam 64 in driving relationship with the piston reciprocating in the valve cylinder device of the second (offset) housing bore 52 is also offset from a position equally spaced with respect to the first and third cams 62, 66. For example, if the second housing bore 52 is offset from the alignment axis 16 of the first and third housing bores 50, 54 by 30°, the second cam 64 may be (rotationally) offset from the first cam 62 by 90° about the axis of rotation in a first rotational sense (e.g. clockwise), the third cam 66 may be (rotationally) offset from the first cam 62 by 240° about the axis of rotation in the said first rotational sense, and the third cam 66 may be (rotationally) offset from the second cam 64 by 150° about the axis of rotation in the said first rotational sense. This enables the first, second and third cams 62, 64, 66 to drive the pistons reciprocating in the housing bores 50, 52, 54 at phases which are successively 120° apart (i.e. at phases which are equally spaced).

Figure 7:
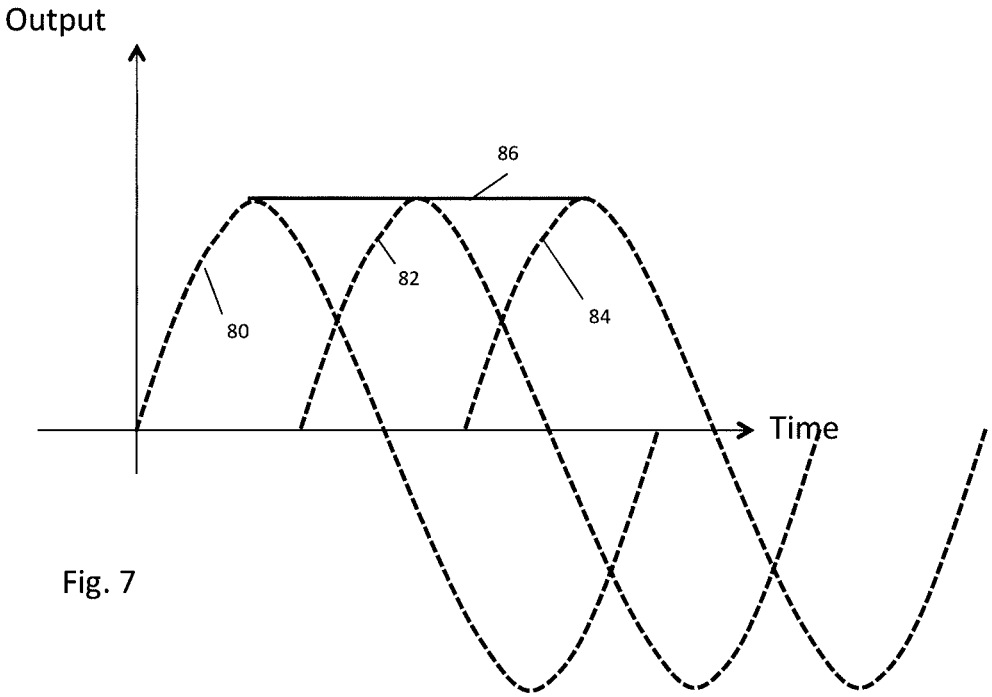
FIG. 7 is a plot of hydraulic fluid output from a group of piston cylinder assemblies of the hydraulic pump of FIGS. 2-6 versus time.

The cams 62, 64, 66 and the piston feet 60*a* slidably bear against one another such that, when the cams 62, 64, 66 drive the pistons 60 reciprocating in the cylinders 42/housing bores 50, 52, 54 of the first group 30, each of the pistons 60 reciprocates in respective cylinders/housing bores to generate a sinusoidal output 80-84 (see FIG. 7). As the cams 62, 64, 66 drive the pistons 60 at phases which are equally spaced, the sinusoidal outputs 80-84 of the piston cylinder assemblies of the first group 30 combine to provide a substantially smooth pressurised fluid output 86.

The integrated valve units 40 of the valve cylinder devices 39 are configured to operate as both a low and a high pressure valve and typically comprise a valve member which is engageable with a valve seat. The opening and/or the closing of the low pressure valve (and optionally also the high pressure valve) is electronically actuatable under the active control of previously described common controller 70 (see FIG. 1). A position and speed sensor may be provided which determines the instantaneous angular position and speed of rotation of the crankshaft 4, and which transmits shaft position and speed signals to the controller 70. This enables the controller 70 to determine instantaneous phase of the cycles of each individual working chamber. The controller 70 thus regulates the opening and/or closing of the low and high pressure valves to determine the displacement of fluid through each working chamber (or through the working chambers of each group 30, 32, 34, 36), on a cycle by cycle basis, in phased relationship to cycles of working chamber volume, to determine the net throughput of fluid through each of the groups of valve cylinder devices according to respective demands (e.g. demand signals input to the controller 70).

Each group may be associated with a particular demand signal. For example, the net displacement of the first group may be selected responsive to a first demand signal (e.g. relating to the requirements of motor 10) and the net displacement of the second group may be selected responsive to a second demand signal (e.g. relating to the requirements of the work function 8) different (and independently) from the first demand signal. As will be explained below, the third group 34 may be combined with the first group 30 such that the net displacement of the third group 34 is determined by the controller 70 together with that of the first group 30 in response to a combined (first) demand signal. As will also be explained below, the fourth group 36 may be a "universal service" group whose net displacement is determined by the controller 70 responsive to the first and second demand signals. For example, if the first demand signal is greater than the second demand signal, and the first demand signal exceeds a threshold, the displacement of the fourth group of piston cylinder assemblies may be selected to augment the displacement of the first group 30. Conversely, if the second demand signal is greater than the first demand signal, and the second demand signal exceeds a threshold, the displacement of the fourth group of piston cylinder assemblies may be selected to augment the displacement of the second group 32.

It will be understood that the low pressure valve acts as an inlet valve and the high pressure valve as an outlet valve, unless the hydraulic pump 6 is a hydraulic pump-motor operating in motoring mode, in which case the low pressure valve acts as an outlet valve and the high pressure valve acts as the inlet valve. However, the terminology used here, unless otherwise stated, assumes the hydraulic pump 6 is operating as a pump.

Figure 8A:
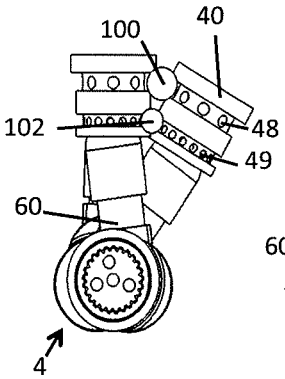
FIGS. 8*a*-8*c* are front, side and perspective views of the crankshaft, pistons and valve cylinder devices of a group of piston cylinder assemblies disposed about and extending away from the crankshaft of FIGS. 6*a*-6*d*, FIGS. 8*a*-8*c* also illustrating first and second common conduits fluidly connecting the low pressure valves within the group and the high pressure valves within the group respectively.
Figure 8B:
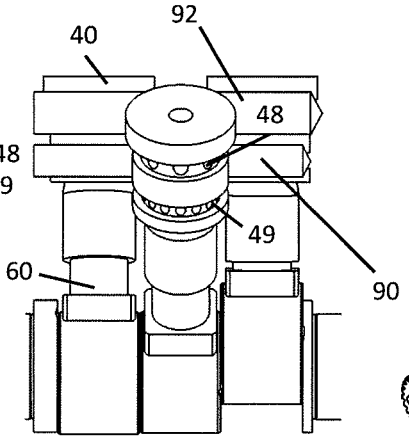
Figure 8C:
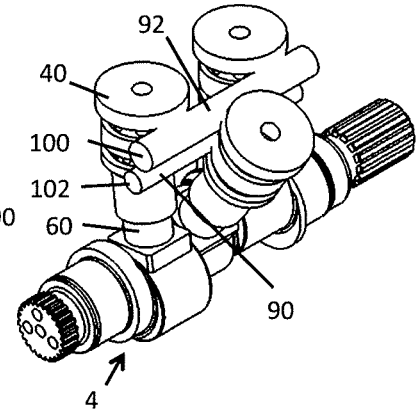

FIGS. 8*a*-8*c* are front, side and perspective views of the crankshaft, pistons and valve cylinder devices of the first group 30. In the illustrated embodiment, the valve units 40 of the valve cylinder devices 39 comprise working fluid outlets 48 and working fluid inlets 49. The working fluid outlets 48 and inlets 49 are annular galleries recessed within the periphery of valve unit 40 (typically each gallery in direct fluid communication with a plurality of generally radially arranged ports) circumferentially distributed around the valve units. The low pressure valves of the integrated valve units 40 coupled to the housing bores 50, 52, 54 of the first group 30 are in fluid communication with each other via a first common conduit 90 which intersects the inlets 49 (typically at least one inlet port per low pressure valve). It will be understood that, in order for the first common conduit 90 to intersect the inlets 49, the first common conduit 90 typically intersects the housing bores 50, 52, 54 in which the valve cylinder devices 39 of the first group 30 are provided. In addition, the high pressure valves of the integrated valve units 40 coupled to the housing bores 50, 52, 54 of the first group 30 are in fluid communication with each other by a second common conduit 92 which intersects the outlets 48. It will be understood that, in order for the second common conduit 92 to intersect the outlets 48, the second common conduit 92 typically intersects the housing bores 50, 52, 54 in which the valve cylinder devices 39 of the first group 30 are provided. The second, third and fourth groups 32, 34, 36 also comprise respective common inlet conduits and respective common outlet conduits.

The common outlet conduits of each of the four groups 30, 32, 34, 36 and the common inlet conduits of at least the first group 30 (and in some cases also the common inlet conduits of the second, third and/or fourth groups 32, 34, 36) have longitudinal axes parallel to the axis of rotation 24 and are typically formed by single straight drillways extending through the cylinder block 20 (see below). The longitudinal axes of these common conduits are (rotationally) offset from the first and third housing bores 50, 54 of their respective groups about the axis of rotation 24 in a first rotational sense (e.g. clockwise) and (rotationally) offset from the second housing bore 52 of their respective groups about the axis of rotation in a second rotational sense opposite the first rotational sense (e.g. anticlockwise) such that they have circumferential positions circumferentially between the circumferential positions of the second housing bore 52 of that group and the circumferential positions of the first and third housing bores 50, 54 of that group. This is a space efficient arrangement which is made possible because the second housing bore 52 is axially offset from the first and/or third housing bores 50, 54 and the second housing bore 52 is (rotationally) offset from the first and third housing bores 50, 54 about the axis of rotation 24.

By fluidly connecting the low pressure valves and the high pressure valves via respective (single) common conduits, fewer conduits need to be formed within the cylinder block 20, and importantly each conduit can be drilled in a single operation and thus manufacture is faster and less expensive. In addition, as the cams 62, 64, 66 drive the pistons reciprocating in the housing bores 12 of each group at different phases, the common conduits 90, 92 can have smaller diameters than might otherwise be the case because they do not have to have capacity for the combined peak flows from or to all of the piston cylinder assemblies of that group.

As the valve inlets and outlets are in the form of annular galleries, the orientation of the valve units 40 has little influence on the fluid communication of the valves with the common conduits 90, 92. However in alternative embodiments, the valve inlets/outlets may be directional (rather than annular galleries), for example the valve inlets and/or outlets may each comprise a single drilling (which may be perpendicular to the axis of rotation, for example). In this case, the valve units 40 need to be oriented and aligned with corresponding common conduits prior to securing in position, to ensure fluid communication therebetween.

It may be that the second housing bore 52 is canted with respect to the first and third housing bores 50, 54 such that the longitudinal axis of the second housing bore 52 (along which the piston reciprocating within the second housing bore 52 reciprocates) intersects with the longitudinal axis of the first and/or third housing bores 50, 54 (along which the respective pistons reciprocate in the respective first and/or third housing bores) at the axis of rotation 24 when viewed along the axis of rotation. However, in some cases, the second housing bore 52 may be canted with respect to the first and third housing bores 50, 54 such that the longitudinal axis of the second housing bore 52 intersects with the longitudinal axis of the first and/or third housing bores 50, 54 at a point above the axis of rotation 24 (i.e. closer to the second 52 and first and/or third housing bores 50, 54 than the axis of rotation 24 is to the second 52 and first and/or third housing bores 50, 54) when viewed along the axis of rotation. This allows more space to be provided for the common conduits 90, 92.

In each of the first, second, third and fourth groups of piston cylinder assemblies, the first (inlet) common conduit is fluidly connected to a respective working fluid inlet 100*a*-100*d* (see FIGS. 2, 5) through which (low pressure) working fluid is input to the piston cylinder assemblies of that group (via the respective valve inlets) and the second (outlet) common conduit is connected to a respective working fluid outlet 102*a*-102*d* from which (pressurised) working fluid is output from the groups. More specifically, in the illustrated embodiment, the first common conduits of the first and third groups 30, 34 extend parallel to the axis of rotation as far as the working fluid inlets 100*a*, 100*c* provided on the front axial end face of the cylinder block 20, but the working fluid inlets 100*b*, 100*d* of the second and fourth groups 32, 36 are provided on a radially inner (with respect to the crankshaft 24) wall of the cylinder block 20 such that they are in (direct) fluid communication with the volume surrounding the crankshaft 4 (i.e. with the crankcase). Accordingly, in some embodiments, the second and fourth groups comprise common inlet conduits which extend parallel to the axis of rotation. In this case, additional conduits may be provided to connect the common conduits of the respective second and fourth groups to the working fluid inlets 100*b*, 100*d* of those groups. However, more typically, the (inlet) common conduits of the second and fourth groups extend radially or substantially radially outwards from the axial bore in the cylinder block to the valve inlets of the second and fourth groups 32, 36.

The second common (outlet) conduit of each group 30, 32, 34, 36 extends parallel to the axis of rotation as far as a respective working fluid outlet 102*a*-102*d* on the front axial end face of the cylinder block 20 from which (pressurised) working fluid is output from that group.

As each group 30, 32, 34, 36 has its own working fluid inlet 100*a*-100*d*, each group 30, 32, 34, 36 can receive working fluid from a different source, and each different source may provide fluid at different pressures. Further, as each group 30, 32, 34, 36 has its own working fluid outlet, each group 30, 32, 34, 36 can provide a discrete pressurised fluid service output to a different hydraulic load. Moreover, as the displacements of the piston cylinder assemblies of each group are independently controllable by the controller 70, the discrete pressurised fluid outputs of each group are also independently controllable. Thus, the groups 30, 32, 34, 36 can provide independent service outputs of pressurised fluid to different hydraulic loads in place of multiple individual pumps. As the groups 30, 32, 34, 36 are provided in the same housing, and are driven by the same crankshaft which shares the same crankcase (whereas multiple individual pumps would have their own housings, individual crankshafts and crankcases), using different groups 30, 32, 34, 36 of piston cylinder assemblies of the same pump 6 to power different hydraulic loads provides a substantial weight (and space) saving over the use of multiple pumps. It is further noted that, in this arrangement, the gearbox typically required to split the mechanical torque from torque source 2 to the individual crankshafts of multiple individual pumps can be omitted because multiple groups are driven by the same crankshaft, thereby saving further size, weight and complexity. In addition, the same controller 70 can be used to control the net displacements of each group of piston cylinder assemblies.

Referring back to the illustrated embodiment of FIG. 1, in particular when seen in context with the specific embodiment of the hydraulic pump 6 as presently described, although each group 30, 32, 34, 36 can provide a discrete, independently controllable service output, the outputs of the first and third groups 30, 34 are combined ("ganged together") to provide a combined service output 110 (but it will be understood that this is not necessarily the case). Typically, this is achieved by providing an endplate (not shown) bolted to the front axial face of the cylinder block 20, and combining the working fluid outlets 102*a*, 102*c* of the first and third groups at the endplate. In this case, the net displacement of the first and third groups 30, 34 is controlled by the controller 70 responsive to the same (first) demand signal.

As also shown in FIG. 1, the combined output 110 from the first and third groups supplies pressurised hydraulic fluid to the hydraulic pump-motor 10 which propels the wheels 12 of the forklift truck. The working fluid inlets 100*a*, 100*c* of the first and third groups 30, 34 are also combined at the endplate to provide a combined working fluid inlet 114. The combined working fluid inlet 114 receives working fluid from a return line 111 from the hydraulic pump-motor 10, thereby forming a closed loop hydraulic circuit comprising the first and third groups 30, 34 and the hydraulic motor 10. It will be understood that the fluid pressure in the low pressure side of the closed loop hydraulic circuit (i.e. in the line 111 between the output of the motor 10 and the combined input 114 of the first and third groups of the pump 6) is typically pressurised (pre-charged).

The working fluid inlet 100*b* of the second group 32 receives working fluid from a hydraulic tank 130 (which tank 130 may comprise, or at least be in fluid communication with, the crankcase) via fluid line 115, and the working fluid outlet 102*b* of the second group 32 provides pressurised working fluid to the work function 8 via fluid line 116. The work function 8 returns low pressure working fluid back to the tank 130 via return line 117, thereby forming an open loop hydraulic circuit comprising the tank 130, the second group 32 and the work function 8. The tank 130 may be unpressurised (i.e. at atmospheric pressure); alternatively, where the tank 130 is closed, the pressure of the hydraulic fluid in the tank 130 may be boosted by a charge pump or other pressurising means. As indicated above, the net displacement of the second group 32 is controlled by the controller 70 in accordance with the second demand signal.

The working fluid inlet 100*d* of the fourth group 36 also receives working fluid from the hydraulic tank 130. As shown in FIG. 1, the working fluid outlet 102*d* of the fourth group 36 is selectively fluidly connected to output line of the second group 32 and to the combined output line 110 from the first and third groups 30, 34 by a switching unit (or valve) 118 which is in electronic communication with the controller 70 (or alternatively with a different controller). The controller 70 is configured to switch the switching unit 118 between a first mode in which the switching unit 118 fluidly connects the working fluid outlet 102*d* of the fourth group 36 to the output 110 from the first group along a first path (in which mode the outlet 102*d* of the fourth group 36 is not typically connected to the output line 116) and a second mode in which the switching unit 118 fluidly connects the working fluid outlet 102*d* of the fourth group 36 to the output 116 from the second group along a second path (in which mode the outlet 102*d* of the fourth group is not typically connected to the output line 110), and optionally a third, idle mode in which the output 102*d* from the fourth group 36 is disconnected from outputs 110, 116. The fourth group 36 thus provides a "universal" service which can be selected to provide additional pressurised fluid to either the working fluid service output 110 from the first (and third) group(s), or the working fluid output 116 from the second group 32 depending on the first and second demand signals (from the motor 10 and the work function 8). The controller 70 is typically configured to select the output from the fourth group 36 to support the working service output 110 from the first and third groups 30, 34 under periods of high demand from the pump-motor 10, and to support the working service output 116 from the second group 32 under periods of high demand from the work function 8. As it is typically rare that there will be high demand from both the pump-motor 10 (which provides the propel function) and the work function 8 simultaneously, the overall combined displacement of the groups 30, 32, 34, 36 can be less than the combined overall displacement which would be required from separate pumps.

The working fluid inlets 100*b*, 100*d* of the second and fourth groups (and the corresponding common (inlet) conduits 90 of the second and fourth groups) may have greater internal diameters than the working fluid inlets 100*a*, 100*c* of the first and third groups to allow higher flow rates, particularly when the first and third groups are pre-charged and the second and fourth groups are not (e.g. when the second and fourth groups are connected directly to an unpressurised crankcase).

Although the open loop and closed loop hydraulic circuits are distinct, there is some fluid shared between the open and closed loop hydraulic circuits via the crankcase. For example, there is typically a leakage path between the piston cylinder assemblies of the first and third groups 30, 34 to the crankcase. Accordingly, fluid from the closed loop circuit can flow to the tank 130 (which typically comprises or is in fluid communication with the crankcase) from which the second group 32 receives hydraulic fluid. Thus, fluid from the closed loop circuit enters the open loop circuit. Furthermore, leaked fluid from the closed loop hydraulic circuit is replaced with hydraulic fluid from the tank 130 (to which the work function 8 of the open loop circuit returns low pressure fluid) via a charge pump 180 (which although not shown in FIGS. 2-5 or FIG. 8 is also driven by the crankshaft 4). Typically the charge pump 180 is used to drive a hydraulic power steering unit 182 of the forklift truck via an output line 183. However, the output line 183 of the charge pump 180 is also fluidly connected via a check valve 184 to the low pressure side of the closed loop hydraulic circuit such that, when the pressure in the output line 183 of the charge pump 180 is greater than the pressure in the low pressure side (return line 111) of the closed loop hydraulic circuit by a threshold amount, the check valve 184 opens and excess pressurised fluid from the charge pump 180 enters the low pressure side of the closed loop hydraulic circuit. Thus, fluid from the open loop circuit enters the closed loop circuit.

When the fourth group 36 is used to support the flow to the hydraulic motor 10 (e.g. during periods of high demand from the motor 10), there will be a surfeit of hydraulic fluid fed back to the combined working fluid inlet 114 of the first and third groups 30, 34. Accordingly, a pressure relief valve 190 is fluidly connected between the return line 111 from the hydraulic motor 10 and the tank 130. When the pressure in the return line 111 exceeds a threshold (or if the tank 130 is pressurised, when the pressure in the return line exceeds the tank pressure by a threshold amount), the pressure relief valve opens, thereby draining excess fluid from the return line to the tank 130. It will be understood that working fluid fed into the closed loop circuit from the fourth group 36 from the hydraulic tank 130 will typically be at a lower temperature than fluid output by the hydraulic motor 10 to the return line. Accordingly, by draining high temperature fluid output by the hydraulic motor 10 from the closed loop circuit and replacing it with lower temperature fluid from the tank 130, cooling takes place in the closed loop circuit. Preferably, a heat exchanger 191 (shown in dotted lines in FIG. 1) is provided between the pressure relief valve 190 and the tank 130 to cool the fluid taken from the closed loop, thereby ensuring that high temperature fluid drained from the closed loop circuit does not increase the temperature of the fluid in the tank 130.

As stated above, it is not necessary for the outputs of the first and third groups 30, 34 to be combined to provide a combined service output 110. However, this is an advantageous arrangement for applications where the propel function typically requires more power than the work function (e.g. in forklift applications). In other embodiments where the work function typically requires more power than the propel function (such as in "man lift" applications where the hydraulic system is employed to move a trolley platform, e.g. for window cleaning), it may be that the outputs of the second and third groups 32, 34 are combined to provide a combined service output 116 rather than the outputs of the first and third groups 30, 34 being combined to provide combined output 110. The working fluid inlets 100*a*, 100*c* of the first and third groups 30, 34 are not combined in this case, and the working fluid inlets 100*b*, 100*c* of the second and third groups 32, 34 typically receive working fluid from the hydraulic tank 130. It will be understood therefore that the working fluid inlet 100*c* of the third group is typically formed on the radially inner wall of the cylinder block in this case, and that the common inlet conduit 90 of the third group 34 typically extends radially or substantially radially outwards from the axial bore in the cylinder block to the valve inlets of the third group.

The hydraulic pump 6 may be manufactured as follows. The cylinder block 20 is typically formed by casting or machining a central axial bore 22 through the centre of a monolithic billet of material, and the housing bores 50, 52, 54 of each group are typically formed in the cylinder block 20 by drilling bores substantially radially through the billet with respect to the central axial bore 22, the bores being disposed about and extending outwards with respect to the axial bore 22. The housing bores 50, 52, 54 may alternatively be cast in the billet with the central axial bore 22 before being subsequently drilled. As explained above, the first and third housing bores 50, 54 of each group are axially offset from each other, the second housing bore 52 is axially offset from (and axially between) the first and third housing bores 50, 54 and the second housing bore 52 is offset from the first and third housing bores 50, 54 about the central axial bore 22. The groups 30, 32, 34, 36 of housing bores are spaced from each other about the central axial bore 22. In addition, the housing bores 50, 52, 54 of each group are provided with a space-efficient nesting arrangement whereby the second housing bore has an axial extent which overlaps at least partly with axial extent of one, or the axial extents of both, of the first and third housing bores 50, 54.

The common outlet conduits 92 are formed by drilling straight drillways through the cylinder block 20 between the housing bores 50, 52, 54 of the respective groups. The drillways extend parallel to the axial bore 22. For at least the first group 30, the common inlet conduit 90 is also formed by drilling a straight drillway through the cylinder block 20 parallel to the axial bore 22 between the housing bores 50, 52, 54 of the first group and an axial face of the cylinder block.

As indicated above, in some embodiments the second, third and/or fourth groups 32, 34, 36 also comprise common inlet conduits 90 extending parallel to the axis of rotation of the crankshaft. In this case, the common inlet conduits 90 of the second, third and/or fourth groups 32, 34, 36 are also formed by drilling straight drillways through the cylinder block 20 between the housing bores 50, 52, 54 of the respective second, third and fourth groups parallel to the axial bore 22. However, additional conduits are drilled (or exist in cast form) in a radial or substantially radial direction (with respect to axial bore 22) between the common inlet conduits 90 of the second and fourth groups and working fluid inlets 100*b*, 100*d* formed on the radially inner wall of the cylinder block 20, thereby bringing the respective working fluid inlets and common inlet conduits into fluid communication with each other. In embodiments where the third group receives working fluid from the return line 111 from the hydraulic pump-motor 10, such an additional conduit is not required in respect of the third group; rather the common inlet conduit extends through the cylinder block 20 parallel to the axis of rotation of the crankshaft between the housing bores 50, 52, 54 of the third group and an axial face of the cylinder block (where the third working fluid inlet 100*c* is provided). However, in embodiments where the third group receives working fluid from the crankcase, such an additional conduit may also be provided in respect of the third group (to fluidly connect the third group to the third working fluid inlet 100*c* on the radially inner wall of the cylinder block 20). In more typical embodiments the second and fourth groups 32, 36 and, in embodiments where the third group receives working fluid from the crankcase, the third group 34, have respective common inlet conduits extending radially or substantially radially from the crankcase, the common inlet conduits extending radially or substantially radially from the axial bore 22. In this case, the common inlet conduits of the second, third and fourth groups may be formed by forming drillways in a radially or substantially radially outer direction (with respect to axial bore 22) from the working fluid inlets 100*b*, 100*c*, 100*d* of the second, third and fourth groups formed on the radially inner wall of the cylinder block 20 to intersect the respective valve inlets within each of the second, third and fourth groups.

As described above, the longitudinal axes of the common outlet conduits 92 of each group, and the common inlet conduits 90 of at least the first group 30 (and in some embodiments also the common inlet conduits of the second, third and fourth groups 32, 36) are (rotationally) offset from the first and third housing bores 50, 54 of that group about the axis of rotation 24 in a first rotational sense (e.g. clockwise) and (rotationally) offset from the second housing bore 52 of that group about the axis of rotation in a second rotational sense opposite the first rotational sense (e.g. anticlockwise) such that they are disposed circumferentially between the second housing bore 52 and the first and third valve housing bores 50, 54.

A thread cutting tool is used to add the thread to the outer ends of the housing bores for mating with the corresponding thread on the integrated valve units 40. Integrated valve units 40 are screwed into the respective housing bores 50, 52, 54 of each group. Pistons 60 may be mounted to con-rods (the bottoms of which have piston feet) resting on (or coupled to) the cams 62, 64, 66 of the crankshaft 4 such that the pistons 60 are in driving relationship with the cams 62, 64, 66, the crankshaft 4 is mounted in the axial bore 22 and the pistons 60 are reciprocably received by the housing bores 50, 52, 54 of the respective groups 30, 32, 34, 36. As explained above, the cams 62, 64, 66 of the crankshaft 4 are arranged offset about the axis of rotation 24) such that they drive the pistons 60 within each group at phases which are substantially equally spaced. In order to achieve equally spaced phases of output from a group, the arrangement of the cams is typically rotationally uneven. More specifically, unlike axially aligned valve cylinder devices leading to a cam offset requirement of 120° the angle of offset of the cams is adjusted according to the rotational offset of one of the valve cylinder devices (deviating from axial alignment).

In some embodiments, the third housing bore 54 and associated valve cylinder device 39 and piston 60 may be omitted from each group 30, 32, 34, 36. However, the third housing bore 54 and associated valve cylinder device 39 and piston 60 are preferably included in order to reduce the peak to peak variation associated with a two valve cylinder per group architecture, and provide a substantially smooth output from each group 30, 32, 34, 36.

Further variations and modifications may be made within the scope of the invention herein described. For example, it may be that more or fewer than three valve cylinder devices are provided in each group 30, 32, 34, 36. It may be that there are more or fewer than four groups. Additional information, in particular additional features, embodiments and advantages of the present invention can be found in the applications that were filed at the European patent office on 18 Jun. 2013 by the same applicants under the official filing numbers EP13172511.1 and EP13172510.3 and on 27 May 2014 as PCT applications under the official filing numbers PCT/EP2014/060896 and PCT/EP2014/060897. The disclosures of said applications are considered to be fully contained in the present application by reference.

While the present disclosure has been illustrated and described with respect to a particular embodiment thereof, it should be appreciated by those of ordinary skill in the art that various modifications to this disclosure may be made without departing from the spirit and scope of the present disclosure.

What is claimed is:

1. A fluid working machine comprising: a housing, a first and a second group of piston cylinder assemblies within said housing, each of the first and second groups of piston cylinder assemblies comprising at least one actively controllable valve, and a controller configured for controlling actuation of each of the at least one actively controllable valves to thereby control the net displacement of fluid by each of said first and second group of piston cylinder assemblies, wherein the controller is designed and arranged in a way to actuate the at least one actively controllable valves associated with the first and second groups of piston cylinder assemblies in a way to actively control the net displacement of fluid by each of the first and second group of piston cylinder assemblies, wherein the controller is designed and configured in a way that the actuation of the at least one actively controllable valves of the first and second groups of piston cylinder assemblies is performed in a way that the first group of piston cylinder assemblies fulfills fluid flow demands and/or motoring demands for a service output of the fluid working machine and the second group of piston cylinder assemblies independently fulfills fluid flow demands and/or motoring demands for a different service output of the fluid working machine, wherein a first set of piston cylinder assemblies associated with different ones of said groups of piston cylinder assemblies are in driving relationship with a first cam of a crankshaft, wherein a second set of piston cylinder assemblies associated with the different ones of said groups of piston cylinder assemblies are in driving relationship with a second cam of the crankshaft, and wherein the piston cylinder assemblies of each group of the first and second groups of piston cylinder assemblies are arranged alternately in a circumferential direction along said crankshaft.

2. The fluid working machine according to claim 1, wherein the controller is designed and arranged in a way to actuate actively controllable valves of at least a third group of piston cylinder assemblies in a way that the at least said third group fulfils a fluid flow demand and/or a motoring demand independently of the first group and/or the second group of piston cylinder assemblies.

3. The fluid working machine according to claim 1, wherein an actuation cycle of the actively controllable valves of at least one group of the first and second groups of piston cylinder assemblies is performed in a way to fulfil the requirements of at least an open fluid flow circuit and/or of a closed fluid flow circuit.

4. The fluid working machine according to claim 1, wherein the actuation of the actively controllable valves of at least one group of the first and second groups of piston cylinder assemblies are adapted to augment the net displacement of fluid of at least a different group of piston cylinder assemblies such that the actuation of the actively controllable valves of at least two groups of piston cylinder assemblies is performed in a way that constitutes a single actuation pattern.

5. The fluid working machine according to claim 1, wherein the controller is configured to actuate the at least one actively controllable valves in a way that at least at least one group of the piston cylinder assemblies is actuated in a pumping mode, while the other group of the piston cylinder assemblies is actuated in a motoring mode.

6. The fluid working machine according to claim 1, wherein the controller is designed and arranged in a way to actuate at least one controllable switching valve for connecting and disconnecting different fluid flow circuits.

7. The fluid working machine according to claim 1, wherein the housing comprises different fluid flow inlets and/or fluid flow outlets, at least for the first and second groups of piston cylinder assemblies and/or wherein the housing is a unitary housing.

8. The fluid working machine according to claim 1, wherein said fluid working machine comprises the crankshaft extending within the housing, and wherein said piston cylinder assemblies comprise a working chamber of cyclically varying volume and being in driving relationship with said crankshaft.

9. The fluid working machine according to claim 1, wherein the first cam and the second cam of the crankshaft are axially offset.

10. The fluid working machine according to claim 2, wherein an actuation cycle of the actively controllable valves of at least one of the groups of piston cylinder assemblies is performed in a way to fulfil the requirements of at least an open fluid flow circuit and/or of a closed fluid flow circuit.

11. The fluid working machine according to claim 2, wherein the actuation of the actively controllable valves of at least one of the groups of piston cylinder assemblies can be adapted to augment the net displacement of fluid of at least a different group of piston cylinder assemblies such that the actuation of the actively controllable valves of at least two groups of piston cylinder assemblies is performed in a way that constitutes a single actuation pattern.

12. The fluid working machine according to claim 1, wherein the controller is configured to actuate the at least one actively controllable valves in a way that at least one group of the piston cylinder assemblies is actuated in a pumping mode, while the other group of the piston cylinder assemblies is actuated in a motoring mode.

13. The fluid working machine according to claim 3, wherein the actuation of the actively controllable valves of at least one of the groups of piston cylinder assemblies can be adapted to augment the net displacement of fluid of at least a different group of piston cylinder assemblies such that the actuation of the actively controllable valves of at least two groups of piston cylinder assemblies is performed in a way that constitutes a single actuation pattern.

14. The fluid working machine according to claim 1, wherein the actuation is controlled on a cycle-by-cycle basis for at least some of the piston cylinder assemblies.

15. The fluid working machine according to claim 8, wherein the housing is a single-piece housing.

16. The fluid working machine according to claim 6, wherein the different fluid flow circuits are associated to at least one group of the piston cylinder assemblies.

17. A fluid working machine comprising:

a housing;

a first group of piston cylinder assemblies within the housing, each piston cylinder assembly having an actively controllable valve;

a second group of piston cylinder assemblies within the housing, each piston cylinder assembly having an actively controllable valve;

a controller configured for controlling actuation of each of the actively controllable valves;

wherein the controller is configured to control actuation of the actively controllable valves of the first group of piston cylinder assemblies to control the net displacement of fluid by the first group of piston cylinder assemblies;

wherein the controller is configured to control actuation of the actively controllable valves of the second group of piston cylinder assemblies to control the net displacement of fluid by the second group of piston cylinder assemblies;

wherein the controller is configured to control actuation of the actively controllable valves of the first group of piston cylinder assemblies to fulfill fluid flow demands and/or motoring demands for a first service output of the fluid working machine;

wherein the controller is configured to control actuation of the actively controllable valves of the second group of piston cylinder assemblies to fulfill fluid flow demands and/or motoring demands for a second service output of the fluid working machine;

wherein a first set of piston cylinder assemblies, composed of a first piston cylinder assembly of the first group of piston cylinder assemblies and a first piston cylinder assembly of the second group of piston cylinder assemblies, are in a driving relationship with a first cam of a crankshaft;

wherein a second set of piston cylinder assemblies, composed of a second piston cylinder assembly of the first group of piston cylinder assemblies and a second piston cylinder assembly of the second group of piston cylinder assemblies, are in a driving relationship with a second cam of the crankshaft;

wherein the first set of piston cylinder assemblies are arranged alternately in a circumferential direction along the crankshaft; and wherein the second set of piston cylinder assemblies are arranged alternately in a circumferential direction along the crankshaft.

18. The fluid working machine according to claim 17, further comprising:

a third group of piston cylinder assemblies within the housing, each piston cylinder assembly having an actively controllable valve; and a fourth group of piston cylinder assemblies within the housing, each piston cylinder assembly having an actively controllable valve;

wherein the controller is configured to control actuation of the actively controllable valves of the third group of piston cylinder assemblies and the fourth group of piston cylinder assemblies to control the net combined displacement of fluid by the third group of piston cylinder assemblies and the fourth group of piston cylinder assemblies.

* * * * *